US006932870B2

(12) United States Patent
Gunn et al.

(10) Patent No.: US 6,932,870 B2
(45) Date of Patent: Aug. 23, 2005

(54) SYSTEM AND PROCESS FOR DISPENSING AN ADHESIVE ONTO A CORE DURING THE FORMATION OF ROLLED PRODUCTS

(75) Inventors: Alexander F. Gunn, North Augusta, SC (US); Richard A. Horton, Martinez, GA (US); Jason A. McDavid, Augusta, GA (US); Christopher L. Satori, Evans, GA (US); Elizabeth E. Metz, Greenville, WI (US); Teresa M. Kaufman, Neenah, WI (US); Mark J. Hassman, Evans, GA (US); Charles B. Strother, Neenah, WI (US); William H. Gilmore, Jr., Neenah, WI (US); Christopher R. Fahrbach, Martinez, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 46 days.

(21) Appl. No.: 10/138,802

(22) Filed: May 3, 2002

(65) Prior Publication Data

US 2003/0207027 A1 Nov. 6, 2003

(51) Int. Cl.[7] ..... B05B 7/00

(52) U.S. Cl. ..... 118/300; 118/305; 118/315; 118/319; 118/320; 118/313; 427/425; 156/390; 156/391; 156/446; 156/450

(58) Field of Search ..... 118/300, 305, 118/315, 319, 320, 313; 427/425; 156/390–391, 446, 450

(56) References Cited

U.S. PATENT DOCUMENTS

| | | | | |
|---|---|---|---|---|
| 3,937,410 A | * | 2/1976 | Justus | 242/530.1 |
| 4,133,495 A | | 1/1979 | Dowd | |
| 4,396,529 A | | 8/1983 | Price et al. | |
| 4,425,836 A | * | 1/1984 | Pickrell | 91/405 |
| 4,682,710 A | * | 7/1987 | Turner et al. | 222/63 |
| 4,787,332 A | | 11/1988 | Geisel et al. | |
| 5,337,968 A | | 8/1994 | De Bin et al. | |
| 5,354,529 A | * | 10/1994 | Berger et al. | 264/176.1 |
| 5,797,559 A | | 8/1998 | Coffey | |
| 5,814,134 A | * | 9/1998 | Edwards et al. | 96/6 |
| 6,045,085 A | | 4/2000 | Andersson et al. | |
| 6,142,407 A | | 11/2000 | McNeil et al. | |
| 6,273,345 B1 | | 8/2001 | Kaligian, II et al. | |
| 6,308,909 B1 | | 10/2001 | McNeil et al. | |
| 6,355,099 B1 | * | 3/2002 | Immordino et al. | 106/778 |

OTHER PUBLICATIONS

Abstract of Japanese Patent No. 01231744, Mar. 11, 1988.

Abstract of Japanese Patent No. 63160962, Jul. 4, 1988.

PCT Search Report, Jun. 18, 2003.

* cited by examiner

*Primary Examiner*—Chris Fiorilla
*Assistant Examiner*—Michelle Acevedo Lazor
(74) *Attorney, Agent, or Firm*—Dority & Manning, P.A.

(57) ABSTRACT

A process and system for applying an adhesive to a core during the production of rolled paper products is disclosed. The system of the present invention is generally directed to the use of pumping devices that meter out constant volumetric amounts of an adhesive onto a core through a plurality of adhesive applicators simultaneously. The systems includes, for instance, a positive displacement pump system in which a fluid at substantially constant pressure is fed to a pumping device for dispensing the adhesive to a plurality of adhesive applicators in constant volumetric amounts.

23 Claims, 3 Drawing Sheets

FIG. 2
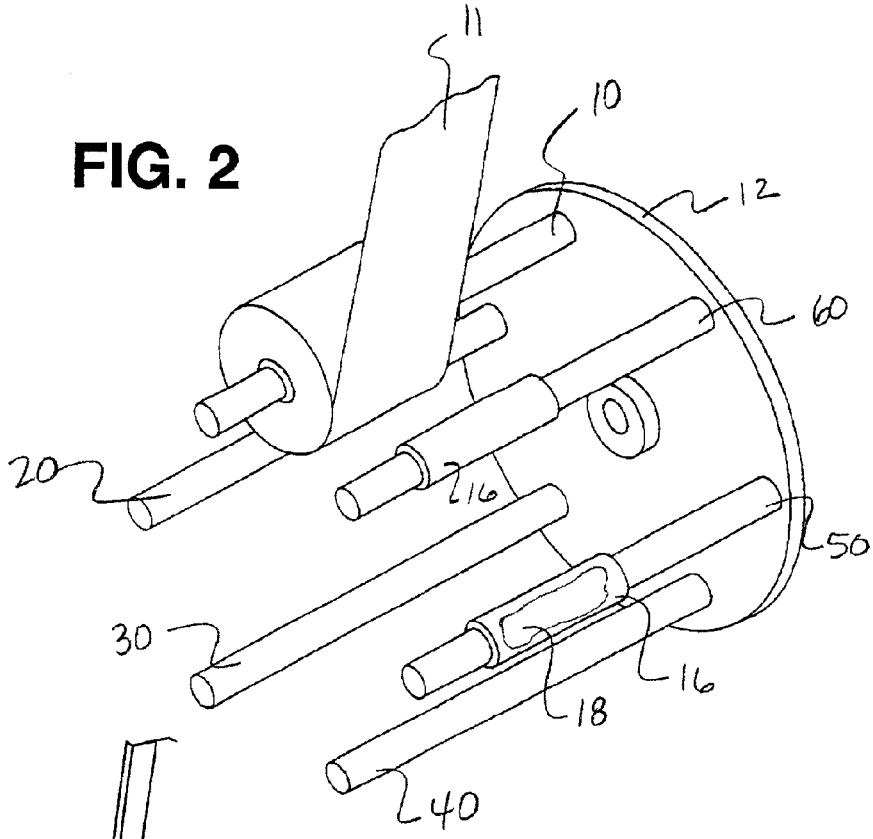
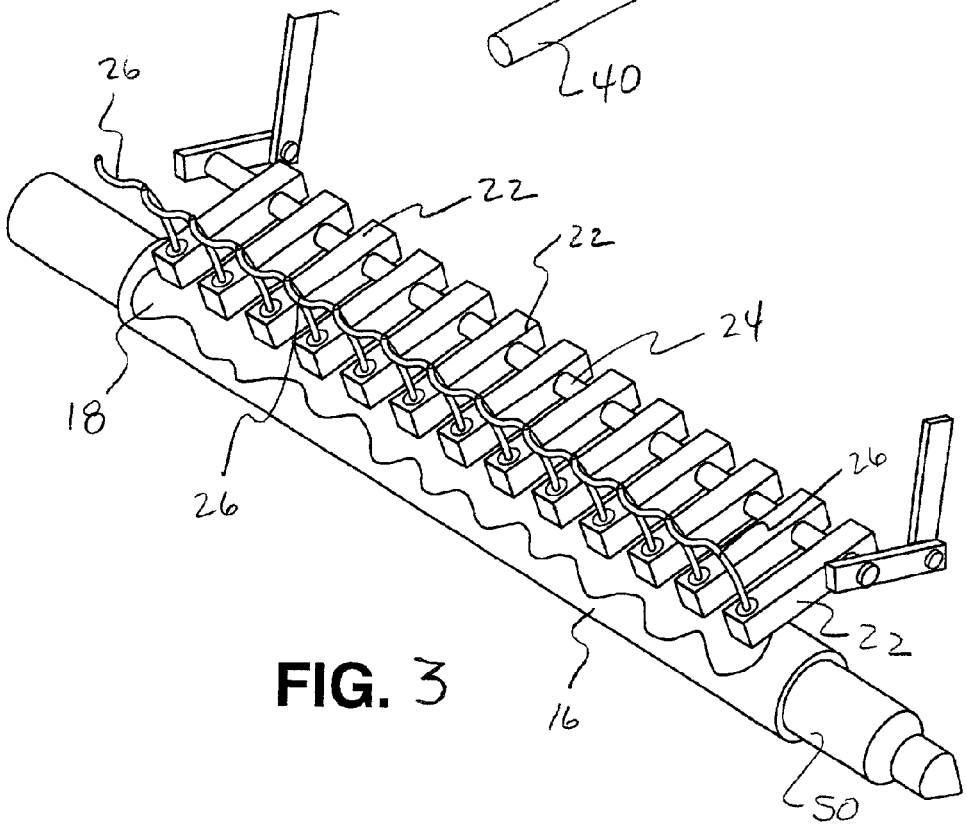
FIG. 3

SYSTEM AND PROCESS FOR DISPENSING AN ADHESIVE ONTO A CORE DURING THE FORMATION OF ROLLED PRODUCTS

BACKGROUND OF THE INVENTION

Various paper products, such as tissues and other paper webs, are typically formed into large supply rolls after being manufactured. In order to commercially utilize paper from these supply rolls, it is necessary to rewind the paper from the large supply roll onto a smaller sized roll, which is generally more useful for commercial purposes. For example, in conventional systems, a core is often placed onto a mandrel that is capable of spinning so that the spinning of the mandrel in conjunction with the core can effectuate winding of the paper thereon.

Techniques for utilizing mandrels for winding paper are generally well known in the art. For example, a turret-style winding system is one well-known method used to wind paper onto a core. Most turret systems include a number of mandrels that are each capable of spinning independently of each other so that multiple paper logs can be formed simultaneously. For example, in some conventional turret systems, a core is first loaded onto a mandrel. An adhesive can then be applied to the core. After the adhesive is applied, the mandrel and core can be spun so that a sheet of paper can be wound around the core. Once the desired amount of paper is wound onto the core, the core and paper can then be removed.

The adhesive is applied to the core so that an end of the paper product will attach to the core for initiating winding of the product. In the past, however, problems have been experienced in applying the adhesive to the core. For instance, if too much of an adhesive is applied to the core, "ballooning" can occur in which excess adhesive accumulates on the core in a particular location causing a bulge to form during winding of the paper product. This bulge caused by the excess adhesive not only creates an imbalance in the core but can also increase tension in the paper web due to the lopsidedness. Ultimately, under some circumstances, the paper web can break causing down time in the equipment. Further, the adhesive can also spatter and build up on the equipment. In fact, it is believed that the process of applying an adhesive to a core in a turret system is one of the major causes of machine down time and delay and is one of the largest factors in limiting the speed of the equipment.

In one known conventional system, the adhesive is maintained in a large tank and is pumped from the tank using a diaphragm pump. The pump dispenses the adhesive into a manifold. The manifold is placed in communication with multiple outlets that feed the adhesive to applicators spaced along a rotatable mandrel onto which a core is placed. A pressure regulator is placed before the manifold for maintaining the adhesive under constant pressure.

Each of the outlets coming off the manifold are connected to an air-actuated valve. By opening and closing the air-actuated valves, the amount of adhesive fed and dispensed through the applicators is controlled.

The above-described system can be considered a constant pressure system in which the flow rate of the adhesive through the air-actuated valves is controlled by increasing or decreasing the pressure of the adhesive using the pressure regulator. Such a system, however, has been found to create variability in the amount of adhesive that is applied to each successive paper core. Ballooning has also been found to occur in the above described system.

As such, a need currently exists for an adhesive application system that applies constant and uniform amounts of an adhesive to a core during the winding of a paper product.

SUMMARY OF THE INVENTION

The present invention recognizes the deficiencies and drawbacks of various prior art systems. Accordingly, the present invention is generally directed to an improved system for applying uniform amounts of an adhesive to a rotating core used in the formation of rolled products. In one embodiment, for instance, the system can include an adhesive supply for containing an adhesive. A pumping device can be placed in communication with the adhesive supply. In accordance with the present invention, the pumping device can be configured to dispense from the adhesive supply constant volumetric amounts of an adhesive.

The system can further include a plurality of adhesive applicators in communication with the pumping device. The plurality of adhesive applicators can be spaced along the length of a rotating mandrel for applying an adhesive to a core positioned on the mandrel. The pumping device can be configured to dispense constant volumetric amounts of the adhesive to each of the adhesive applicators simultaneously. For instance, in one embodiment, the system can include 20 adhesive applicators, particularly at least 30 adhesive applicators, and more particularly at least 40 adhesive applicators. Depending upon the number of adhesive applicators, one or more pumping devices may be needed for dispensing the constant volumetric amounts of the adhesive.

In general, any suitable adhesive can be used in the system of the present invention, such as any conventionally used starch adhesive. The volumetric amounts of the adhesive that are applied to the core can range depending upon the particular adhesive used and the particular adhesive applicator used. For example, in one embodiment, the pumping device can be configured to dispense volumetric amounts in the range of from about 0.03 mL to about 0.2 mL, and particularly from about 0.05 mL to about 0.1 5 mL.

The pumping device used in the present invention to dispense the constant volumetric amounts of the adhesive from the adhesive supply can also vary. In one embodiment, for instance, the pumping device can be a planetary gear pump. In alternative embodiments, the pumping device can be a piston pump or a peristaltic pump.

In one embodiment, a second pumping device can be placed between the adhesive supply and the first pumping device. In addition, a pressure regulator can be placed in between the second pumping device and the first pumping device. In this manner, the second pumping device can be used to create pressure within an adhesive supply line that is controlled by the pressure regulator. The first pumping device used to pump the constant volumetric amounts of the adhesive can be fed the adhesive at constant pressure. The adhesive can be maintained at a pressure, for instance, of from about 5 psi to about 100 psi, and particularly from about 20 psi to about 60 psi.

The system can further include a controller for controlling the pumping device. For example, the controller can be configured to adjust the volumetric amounts dispensed by the pumping device. The controller can also be configured to control the pumping device for dispensing the constant volumetric amounts at particular intervals of time. For example, the pumping device can be controlled for dispensing volumetric amounts of the adhesive after a time interval ranging from about 0.25 seconds to about 3 seconds, and particularly from about 0.5 seconds to about 1.5 seconds.

Other features and aspects of the present invention will be discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which:

FIG. 2 is a perspective view of a plurality of rewinder mandrels illustrating adhesive application according to the present invention;

FIG. 3 is a perspective view of a plurality of adhesive applicators applying adhesive to a core on a mandrel in accordance with the present invention.

Figure 1:
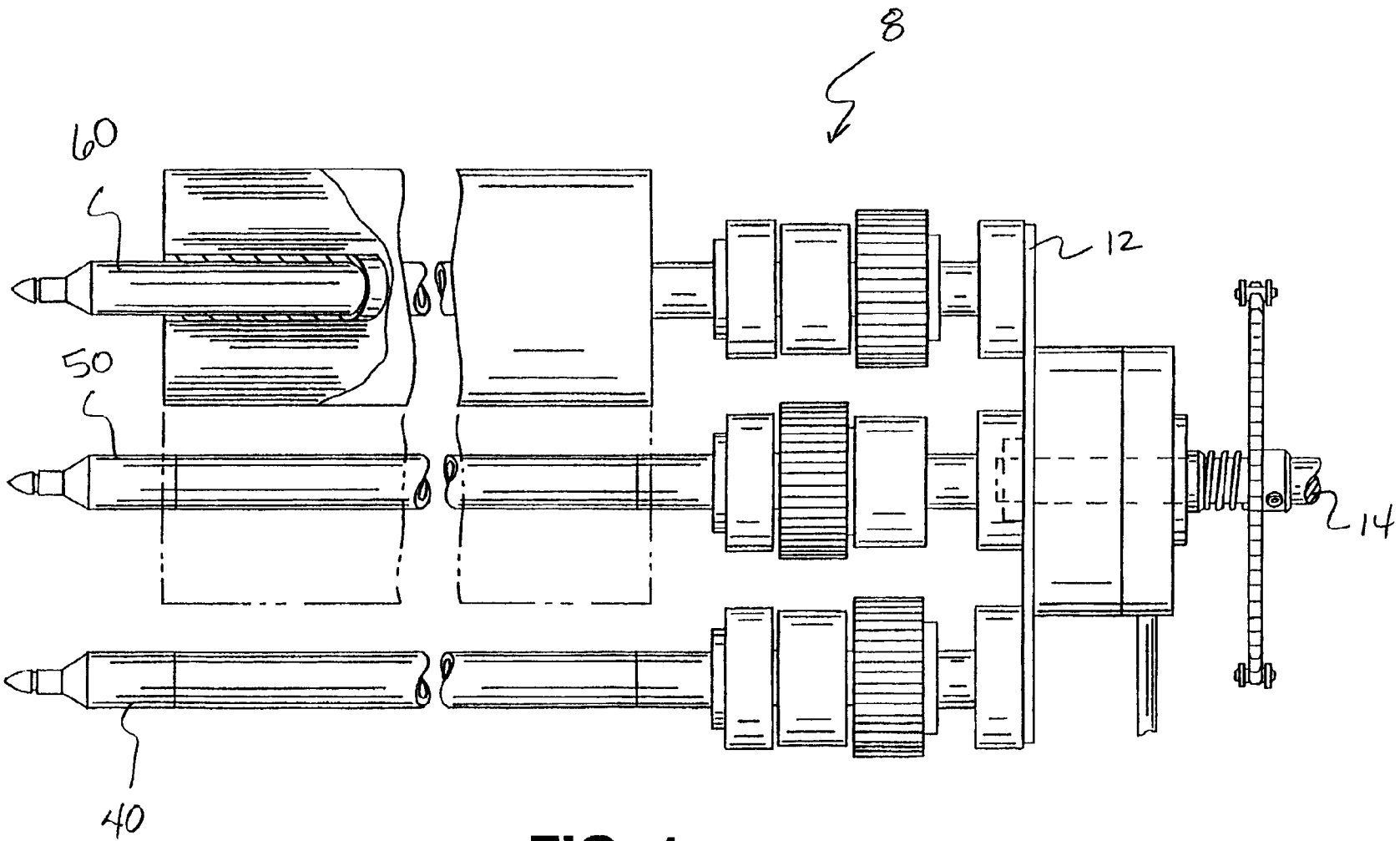
FIG. 1 is a side view with cutaway portions of a rewinder mandrel system that can be used in association with the present invention.

Repeated use of reference characters in the present specification and drawings is intended to represent the same or analogous features or elements of the invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made to the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a system and process for applying an adhesive to a core during the formation of a rolled paper product. In accordance with the present invention, an adhesive is applied to a core in substantially constant volumetric amounts. In this manner, variability between applications of the adhesive is reduced or eliminated. Further, since the system of the present invention is capable of accurately controlling the amounts of adhesive dispensed onto cores, problems associated with adhesive application are reduced, such as adhesive over application and ballooning as described above. Ultimately, the system of the present invention reduces paper web breaks and machine down time.

In general terms, the system of the present invention is directed to the use of a constant volume metering device that is capable of dispensing constant volumetric amounts of an adhesive to a plurality of applicators for application onto a core. The system of the present invention can be used in any suitable adhesive application system. In one embodiment, for instance, the adhesive application system of the present invention can be used in conjunction with a conventional turret assembly that is used for winding paper products onto a core.

In general, turret assemblies often include at least one mandrel that is rotatably affixed to an indexing mechanism. The indexing mechanism, or turret, can rotate a mandrel into a number of positions or "stations" at which various steps of the winding process can occur. For instance, at one position, a core can be placed upon a mandrel. The mandrel can then be rotated for applying an adhesive to the core. At another position, a paper product can be wound onto the core. Finally, at yet another position, the wound paper roll can be removed from the mandrel.

According to the present invention, any turret assembly known in the art is suitable for use in the present invention. Examples of various turret assemblies that can be used in the present invention include, but are not limited to, the turret assemblies described in U.S. Pat. Nos. 4,133,495 to Dowd; U.S. Pat. No. 5,337,968 to De Bin et al.; and U.S. Pat. No. 5,797,559 to Coffey, which are incorporated herein by reference. One particular embodiment of a turret assembly that can used in the present invention is depicted in FIGS. 1–3. However, as stated, it should be understood that the embodiment depicted in FIGS. 1–3 and described herein is but one example of a suitable turret assembly, and that other turret assemblies or core winding systems are equally suitable for use in the present invention.

Referring to FIG. 1, one embodiment of a turret assembly generally 8 of the present invention is illustrated. As shown, a turret assembly 8 can include a turret 12 attached to various mandrels. As stated above, turret 12 can generally be indexed into a variety of positions during the winding process. For instance, as shown in FIGS. 1 and 2, the indexing can occur by rotating the turret about its longitudinal axis, which is axially carried on shaft 14. This rotation of the turret can be accomplished by any of a variety of methods known in the art such as by using gears, belts and/or pulleys.

The turret assembly can also include at least one mandrel for winding paper that is rotatably affixed to the turret. For instance, as shown in FIGS. 1–2, six mandrels 10, 20, 30, 40, 50, and 60 can be rotatably affixed to turret 12. Although turret assembly 8 is depicted in FIG. 1 as including six mandrels, it should be understood that only one mandrel, or any number of mandrels greater than one, can also be used in the present invention.

One embodiment for winding paper onto a core utilizing turret assembly 8 will now be described.

As shown in FIG. 2, the winding process can be initiated by first placing a core 16 onto mandrel 40 according to any method known in the art. The position of mandrel 40 in the embodiments depicted in FIGS. 1–2 can also be described as the "core loading position" of turret 12. Once core 16 is placed onto mandrel 40, turret 12 can then be indexed into an "adhesive application position", which is the position occupied by mandrel 50. In particular, as illustrated in FIGS. 2 and 3, an adhesive 18 can be applied to the core 16. Generally, an adhesive used in the present invention can comprise any of a variety of materials, such as glue, known to adhere paper to a surface.

Referring to FIG. 3, application of the adhesive 18 at the adhesive application position of the mandrel 50 is more clearly shown. As illustrated, the core 16 placed on the mandrel 50 is located adjacent to a plurality of adhesive applicators 22 that are mounted on a frame 24. In particular, the adhesive applicators 22 are based onto the core 16. The adhesive applicators 22 are spaced along the length of the core 16. The number of adhesive applicators present in the system will depend generally on the size of the core and the construction of the applicators 22. In one embodiment, for instance, the core can be approximately 100 inches long and can be placed in association with 60–70 adhesive applicators 22.

The adhesive applicators 22 are in communication with adhesive supply tubes 26. Adhesive flows from the adhesive tubes 26 onto the core 16 through the adhesive applicators 22. As will be described below, the adhesive is metered onto the core in constant volumetric amounts according to the present invention.

Referring back to FIG. 2, once adhesive 18 is applied to core 16, mandrel 40 can be indexed by turret 12 into the "prespin position", which is the position occupied by mandrel 60. At the "prespin position", the mandrel can be rotated to ensure that the mandrel achieves a certain rotational speed before a paper web is wound thereon. In general, a mandrel of the present invention can be rotated by any manner known in the art. For example, drive motor pulleys can be utilized to spin the mandrels.

Once initially rotated at the "prespin position", the mandrel can then be indexed by turret 12 into the "winding position", which is the position occupied by mandrel 10 in the embodiments depicted by FIGS. 1–2. The rotational speed of the mandrel imparted at the "prespin position" is generally greater than the feed speed of the paper web such that, as the rotating mandrel is indexed into the "winding position", a paper web 11 can wind around the mandrel.

After paper web 11 is wound onto the mandrel, it can then be further indexed by turret 12 into a "tail seal position", which is the position occupied by mandrel 20 as shown in FIG. 2. At the "tail seal position", the unattached portions of paper web 11 can be sealed to the roll of paper via a sealing device (not shown). In some embodiments, for example, the sealing device can be configured to apply glue or some other adhesive to the paper web such that the tail can be sealed thereto.

Once sealed, the finished roll of paper can then be removed. In some embodiments, a mandrel containing a finished roll of paper can be indexed by turret 12 into a "removal position", which is the position occupied by mandrel 30 in the embodiments depicted by FIGS. 1–2.

Figure 4:
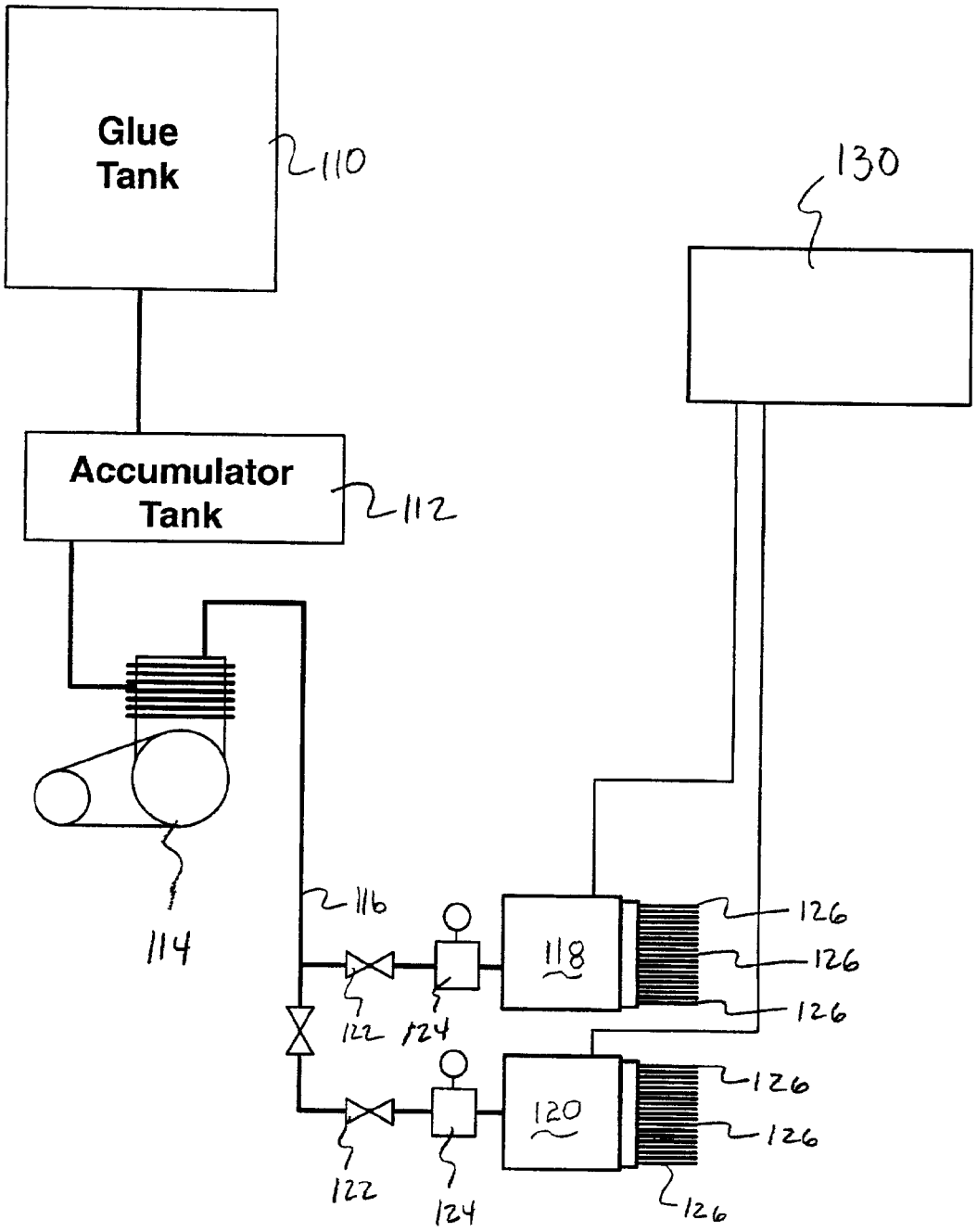
FIG. 4 is a diagrammatical view of one embodiment of a system for applying adhesive to a core in accordance with the present invention.

Referring to FIG. 4, one embodiment of an adhesive applicator system designed to supply adhesive to the adhesive applicators 22 as shown in FIGS. 2 and 3 is illustrated. As described above, the system of the present invention is designed to apply uniform amounts of adhesive to cores during a winding process. The system of the present invention is a "constant volume" system that supplies constant volumetric amounts of an adhesive to cores placed in operative association with the adhesive applicators.

As shown in FIG. 4, this system includes an adhesive supply 110 designed to contain an adhesive. In general, any suitable adhesive can be used in the system of the present invention. The adhesive can be a water-based adhesive or a solvent-based adhesive. For example in one embodiment, a starch adhesive is used. The adhesive can have any suitable viscosity, such as from about 5,000 cp to about 30,000 cp, and particularly from about 10,000 cp to about 14,000 cp.

From the adhesive supply 110, the adhesive is fed into an accumulator tank 112. Accumulator tank 112 is optional but can assist in assuring that an adhesive is continuously supplied to the system. As shown, in this embodiment, the system includes a pump 114, such as a diaphragm pump, that is configured to pump the adhesive from the accumulator tank 112 into a manifold 116. Pump 114 is designed to supply adhesive to the remainder of the system and to ensure that the adhesive is under sufficient pressure prior to being metered out in constant volumetric amounts.

In accordance with the present invention, the manifold 116 is in fluid communication with a first pumping device 118 and a second pumping device 120. Pumping devices 118 and 120 dispense the adhesive from the manifold 116 into the adhesive supply tubes 126. As shown in FIG. 3, the adhesive supply tubes are then connected to a plurality of adhesive applicators for applying the adhesive to a core. In the embodiment illustrated in FIG. 4, the system includes two pumping devices 118 and 120. It should be understood, however, that more or less pumping devices may be needed depending upon the number of adhesive supply tubes and adhesive applicators.

In accordance with the present invention, the pumping devices 118 and 120 are configured to pump the adhesive in constant volumetric amounts. For instance, the pumping devices can be positive displacement pumps. Examples of pumping devices that may be used in the system of the present invention include piston pumps, such as pneumatic piston pumps or rotary piston pumps, and peristaltic pumps. In one particular embodiment of the present invention, the pumping devices 118 and 120 are planetary gear pumps. For example, one particular pumping device well suited for use in the present invention is a planetary gear pump manufactured by Zenith, Parker Hannifin Corp., Zenith Products Division, Part No. 11-62750-7000-0.

In one embodiment of the present invention, the pumping devices 118 and 120 should be capable of dispensing constant volumetric amounts of the adhesive in a range of from about 0.03 mL to about 0.2 mL, and particularly from about 0.05 mL to about 0.15 mL. The above amounts have been found to be well-suited for application to a core along the length of the core when attaching a paper product to the core without over-application of the adhesive and the associated problems of ballooning and adhesive spattering.

In one embodiment, the pumping devices 118 and 120 should also be capable of dispensing constant volumetric amounts of the adhesive to the multiple adhesive supply tubes 126 simultaneously. By dispensing the constant volumetric amounts simultaneously, the time needed to apply the adhesive to a core is greatly reduced and minimized. For instance, the present inventors have discovered that a planetary gear pump such as the one described above can dispense constant volumetric amounts of the adhesive through up to about 32 adhesive supply tubes simultaneously. The number of supply tubes fed by the planetary gear pump, however, can increase or decrease depending upon the design of the pump. In general, when applying an adhesive to a core having a length of approximately 100 inches, at least 20 adhesive applicators are needed, particularly at least 40 adhesive applicators, and more particularly at least about 60 to about 70 adhesive applicators are needed for applying the adhesive uniformly across the length of the core. Planetary gear pumps have been found well-suited for applications where large numbers of adhesive applicators are used.

In the embodiment illustrated in FIG. 4, the system further includes a valve 122 and a pressure regulator 124 positioned upstream of each of the pumping devices 118 and 120. The valves 122 are for turning on and off the flow of adhesive to the pumping devices 118 and 120. For example, when the turret system is in operation, the valve should be placed in an open position and should be closed when the turret system is not running. Valves 122 can be any suitable valves capable of stopping and starting flow. For instance, the valves 122 can be manual valves or can be solenoid valves that automatically open and close in response to the operation of the turret system.

Pressure regulators 124, on the other hand, are configured to control the pressure of the adhesive prior to feeding the adhesive to the pumping devices 118 and 120. In general, pumping devices 118 and 120 will operate with greater accuracy when pressure fluctuations of the adhesive are minimized.

The pressure of the adhesive fed to the pumping devices 118 and 120 will generally depend upon the particular application, the adhesive being used in the system and various other factors. In general, however, the adhesive should be at a pressure of from about 5 psi to about 100 psi, and particularly from about 20 psi to about 60 psi in the lines fed to the pumping devices 118 and 120.

As shown in FIG. 4, the system can further include a controller 130, such as a microprocessor or any other suitable programmable device. The controller 130 can be used to automate the system and make adjustments in the amount of adhesive dispensed over time.

For instance, one of the advantageous of the present invention is that pumping devices 118 and 120 are adjustable. In this regard, the controller can be used to automatically adjust the volumetric amounts dispensed by the pumping devices. These adjustments can be made manually or automatically based on input parameters received by the controller.

In this manner, the system of the present invention can make fine tuning adjustments to the amount of the adhesive dispensed during operation of the system and in response to various parameters. For example, the volumetric amounts of the adhesive dispensed by the pumping devices can be adjusted based on changes in the adhesive properties. For instance, the adhesive properties can change due to temperature fluctuations or by changing the type of adhesive that is used. In fact, adhesives can vary from batch to batch. The system of the present invention allows for slight adjustments in volumetric flow rates based on any variation in the adhesive being dispensed.

The controller 130 can also be used to control the times at which the adhesive is dispensed by the pumping devices 118 and 120. For example, the constant volumetric amounts can be dispensed by the pumping devices onto a core. After the adhesive is dispensed on the core, the pumps can be inactivated for a short period of time to allow for the turret system to be rotated and a new core to contact the adhesive applicators. The controller can be used to discontinue application of the adhesive during the rotation of the turret. For example, in one embodiment, the controller can control the pumping devices 118 and 120 such that there is a time interval delay between the dispensing of the constant volumetric amounts. This time interval delay can be, for instance, from about 0.25 seconds to about 3 seconds in length, and particularly from about 0.5 seconds to about 1.5 seconds in length.

In an alternative embodiment, the pumping devices 118 and 120 can operate in a continuous manner. In order to provide a delay between application of the volumetric amounts of the adhesive, each of the adhesive supply tubes 26 can be placed in communication with a two-way valve. Each of the valves can be used to direct the adhesive flow from the pumping devices 118 and 120 into a recirculation line (not shown). The controller 130 can be used to control the valves such that the flow of adhesive is diverted into the recirculation line when flow of the adhesive to the adhesive applicators is not desired. The recirculation line can return the adhesive to the accumulator tank 112 or to adhesive supply 110.

In addition to the pumping devices 118 and 120, it should be understood that the controller 130 can also be configured to control other valves and instruments contained within the system. For instance, the controller can also be used to control the pump 114, the valves 122 and the pressure regulators 124.

Many adhesive applicator systems used in the past have not been capable of applying amounts of adhesive in a controlled manner. For example, such systems are known to have a variability of greater than 50 percent, and particularly greater than 100%. As used herein, "variability" refers to the percent change in the amount of adhesive dispensed through the adhesive applicators over a determined number of adhesive application cycles, such as 200 cycles. The present inventors have discovered, however, that the system of the present invention provides great advances in minimizing adhesive variability over multiple-adhesive cycles. For example, it has been found that the system of the present invention can have a variability of less than 20%, particularly less than 10% and more particularly less than 5%. In fact, in one embodiment, it is believed that the system of the present invention can have a variability of less than about 2%.

By minimizing adhesive variability, the system of the present invention provides various advantages and benefits. For example, the problems experienced in the past in glue application systems can be minimized. Further, better control of adhesive can allow consistent use of the last sheet of the paper product wound on the core. Many prior art systems, on the other hand, are erratic in producing wound products in which the last sheet can not be separated from the core.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for dispensing an adhesive onto a core for attaching a paper product to be wound onto the core comprising:

an adhesive supply;

a dispensing device in communication with the adhesive supply for pumping an adhesive contained within the adhesive supply into a dispensing reservoir, a positive displacement pumping device in communication with the dispensing reservoir for dispensing constant volumetric amounts of an adhesive from the dispensing reservoir to a plurality of adhesive applicators;

a pressure regulator positioned between the dispensing device and the positive displacement pumping device, the pressure regulator controlling the pressure of an adhesive flowing to the positive displacement pumping device; and a plurality of adhesive supply tubes in communication with and individually connected to the positive displacement pumping device and allowing adhesive pumped out of the positive displacement pumping device to be transported to the plurality of adhesive applicators.

2. A system as defined in claim 1, wherein the dispensing device comprises a pump.

3. A system as defined in claim 1, wherein the adhesive applicators are positioned adjacent to a rotating mandrel for applying an adhesive to a core positioned on the mandrel.

4. A system as defined in claim 3, wherein the positive displacement pumping device is in communication with a plurality of adhesive applicators spaced along a length of the rotating mandrel, the positive displacement pumping device dispensing constant volumetric amounts of an adhesive to each of the adhesive applicators simultaneously.

5. A system as defined in claim 1, wherein the positive displacement pumping device comprises a planetary gear pump.

6. A system as defined in claim 4, wherein the positive displacement pumping device is in communication with at least 20 adhesives applicators.

7. A system as defined in claim 4, wherein the positive displacement pumping device is in communication with at least 30 adhesives applicators.

8. A system as defined in claim 1, wherein the system includes a plurality of positive displacement pumping devices in communication with the dispensing reservoir.

9. A system as defined in claim 1, wherein the positive displacement pumping device comprises a piston pump or a peristaltic pump.

10. A system as defined in claim 1, wherein the positive displacement pumping device is configured to dispense volumetric amounts in a range from about 0.03 mL to about 0.2 mL.

11. A system as defined in claim 1, further comprising a controller configured to selectively control the volumetric amounts dispensed from the positive displacement pumping device.

12. A system as defined in claim 11, wherein the controller is further configured to control the positive displacement pumping device for dispensing the constant volumetric amounts at particular intervals of time.

13. A system for dispensing an adhesive onto a core for attaching a paper product to be wound onto the core comprising:

an adhesive supply for containing an adhesive;

a pumping device in communication with the adhesive supply, the pumping device being configured to dispense from the adhesive supply constant volumetric amounts of an adhesive;

a dispensing device between the adhesive supply and the pumping device for pumping adhesive from the adhesive supply to the pumping device;

a plurality of adhesive applicators in communication with the pumping device, the plurality of adhesive applicators being spaced along a length of a rotating mandrel for applying an adhesive to a core positioned on the mandrel, wherein the pumping device is configured to dispense the constant volumetric amounts of an adhesive to each of the adhesive applicators simultaneously; and a plurality of adhesive supply tubes in communication with and individually connected to the pumping device and allowing adhesive pumped out of the pumping device to be transported to the plurality of adhesive applicators.

14. A system as defined in claim 13, wherein the pumping device comprises a positive displacement pumping device.

15. A system as defined in claim 13, wherein the pumping device comprises a planetary gear pump.

16. A system as defined in claim 13, wherein the pumping device comprises a piston pump or a peristaltic pump.

17. A system as defined in claim 13, further comprising a pressure regulator that controls the pressure of an adhesive being supplied to the pumping device from the adhesive supply.

18. A system as defined in claim 17, wherein the dispensing device is positioned between the pressure regulator and the adhesive supply.

19. A system as defined in claim 13, wherein the pumping device is in communication with at least 20 adhesives applicators.

20. A system as defined in claim 13, further comprising a second pumping device also in communication with the adhesive supply and a plurality of adhesive applicators for dispensing constant volumetric amounts of an adhesive to certain of the adhesive applicators simultaneously, the system including at least 40 adhesive applicators.

21. A system as defined in claim 13, wherein the pumping device is configured to dispense volumetric amounts in a range from about 0.03 mL to about 0.2 mL.

22. A system as defined in claim 13, further comprising a controller configured to selectively control the volumetric amounts dispensed from the pumping device.

23. A system as defined in claim 22, wherein the controller is further configured to control the pumping device for dispensing the constant volumetric amounts at particular intervals of time.

* * * * *

UNITED STATES PATENT AND TRADEMARK OFFICE

CERTIFICATE OF CORRECTION

PATENT NO. : 6,932,870 B2
DATED : August 23, 2005
INVENTOR(S) : A. Gunn et al.

It is certified that error appears in the above-identified patent and that said Letters Patent is hereby corrected as shown below:

Title page,
Item [75], Inventors, "Jason A. McDavid" should read -- James A. McDavid --.

Signed and Sealed this

First Day of November, 2005

JON W. DUDAS
*Director of the United States Patent and Trademark Office*